US010569392B2

(12) United States Patent
Chern

(10) Patent No.: US 10,569,392 B2
(45) Date of Patent: Feb. 25, 2020

(54) ROTARY IMPACT ASSEMBLY STRUCTURE

(71) Applicant: Shwu-Ruu Chern, Taichung (TW)

(72) Inventor: Shwu-Ruu Chern, Taichung (TW)

( * ) Notice: Subject to any disclaimer, the term of this patent is extended or adjusted under 35 U.S.C. 154(b) by 178 days.

(21) Appl. No.: 15/861,975

(22) Filed: Jan. 4, 2018

(65) Prior Publication Data

US 2019/0202037 A1 Jul. 4, 2019

(51) Int. Cl.

| | |
|---|---|
| ***B25B 21/00*** | (2006.01) |
| ***B25B 19/00*** | (2006.01) |
| ***B25B 17/02*** | (2006.01) |
| ***B25B 13/06*** | (2006.01) |
| ***B25B 23/00*** | (2006.01) |

(52) U.S. Cl.

CPC ..... *B25B 21/007* (2013.01); *B25B 13/065* (2013.01); *B25B 17/02* (2013.01); *B25B 19/00* (2013.01); *B25B 23/00* (2013.01); *B25B 23/0035* (2013.01)

(58) Field of Classification Search

CPC ..... B25B 23/00; B25B 23/0035; B25B 17/02; B25B 21/007; B25B 21/02; B25B 19/00; B25B 13/065

See application file for complete search history.

(56) References Cited

U.S. PATENT DOCUMENTS

| | | | | |
|---|---|---|---|---|
| 9,463,557 | B2 * | 10/2016 | Seith | B25B 23/0035 |
| 9,469,017 | B2 * | 10/2016 | Seith | B25B 13/06 |
| 10,315,294 | B2 * | 6/2019 | Rettler | B25B 21/007 |
| 2016/0193724 | A1 * | 7/2016 | Abel | B25B 23/108 81/125 |
| 2019/0126447 | A1 * | 5/2019 | Chu | B25B 23/12 |

* cited by examiner

*Primary Examiner* — David B. Thomas

(74) *Attorney, Agent, or Firm* — Pro-TECHTOR International Services; Ian Oglesby

(57) ABSTRACT

A rotary impact assembly structure includes a rotary tool and a rotary impact assembly. The rotary tool is assembled with the rotary impact assembly so that the rotary impact assembly is driven by the rotary tool to rotate. The rotary impact assembly has a counterweight plate. The counterweight plate has a first surface and a second surface at two sides thereof. The first surface is provided with a socket portion having an insertion hole at a center thereof. The second surface is provided with a plug portion at a center thereof. The rotary impact assembly structure is able to increase the rotational inertia and the amount of torque to quickly loosen or tighten a fastener and has a simple and convenient operation.

7 Claims, 5 Drawing Sheets

ROTARY IMPACT ASSEMBLY STRUCTURE

FIELD OF THE INVENTION

The present invention relates to a rotary impact assembly structure, and more particularly to a rotary impact assembly used for an impact tool (such as, an impact wrench) to increase the rotational inertia so as to quickly loosen or tighten a fastener.

BACKGROUND OF THE INVENTION

A conventional impact wrench is mainly used for loosening or tightening a screw. The common hand impact wrench is a manual impact wrench. One end of the main body is formed with two pivot lugs. A sleeve having a hollow cylinder is provided between the two pivot lugs. The sleeve includes a spring and a reversing member therein. One end of the reversing member is accommodated in the sleeve and leans against the spring. The other end of the reversing member extends out to form a driving head. The peripheral surface of the reversing member is provided with a reversing portion on each of the two opposite sides. The reversing portion has a forward groove and a reverse groove with opposite slopes. The forward groove and the reverse groove are communicated with a turning groove. Two positioning posts are inserted through the pivot lugs, the sleeve and the reversing member in order. The distal ends of the positioning posts are accommodated in the reversing portions of the reversing member.

The above-mentioned conventional structure mainly uses the driving head to engage with a tool part, such as a sleeve, to apply an external force to the hammering surface of the sleeve by means of a hand tool, such as a hammer. The tool part engaged with the driving head is to loosen or tighten the screw through an instantaneous displacement force.

However, these components are complicated, and the user needs to use the hammer to hammer the hammering surface of the sleeve. This is troublesome and inconvenient for operation and use. Besides, since the torque value per hammering is small and fixed, therefore, it takes a lot of time to loosen or tighten the screw. Accordingly, the inventor of the present invention has devoted himself based on his many years of practical experiences to solve these problems.

SUMMARY OF THE INVENTION

The primary object of the present invention is to provide a rotary impact assembly structure that is able to increase the rotational inertia and the amount of torque to quickly loosen or tighten a fastener and has a simple and convenient operation.

Another object of the present invention is to provide a rotary impact assembly structure that can be mated with a plurality of connecting sockets of different specifications, which not only facilitates the replacement but also effectively reduces the purchase cost.

In order to achieve the aforesaid objects, the rotary impact assembly structure of the present invention comprises a rotary tool and a rotary impact assembly. The rotary tool is assembled with the rotary impact assembly so that the rotary impact assembly is driven by the rotary tool to rotate.

The rotary impact assembly has a counterweight plate. The counterweight plate has a first surface and a second surface at two sides thereof. The first surface is provided with a socket portion having an insertion hole at a center thereof. The second surface is provided with a plug portion at a center thereof.

Preferably, the first and second surfaces of the counterweight plate each have an annular recess at a predetermined position.

Preferably, the counterweight plate has a plurality of through holes.

Preferably, the socket portion of the counterweight plate has a positioning assembly at a predetermined position.

Preferably, the plug portion of the counterweight plate has a positioning assembly at a predetermined position.

Preferably, the positioning assembly includes a spring and a steel ball.

Preferably, the rotary tool is a pneumatic tool or an electric tool.

DETAILED DESCRIPTION OF THE PREFERRED EMBODIMENTS

Embodiments of the present invention will now be described, by way of example only, with reference to the accompanying drawings.

Figure 1:
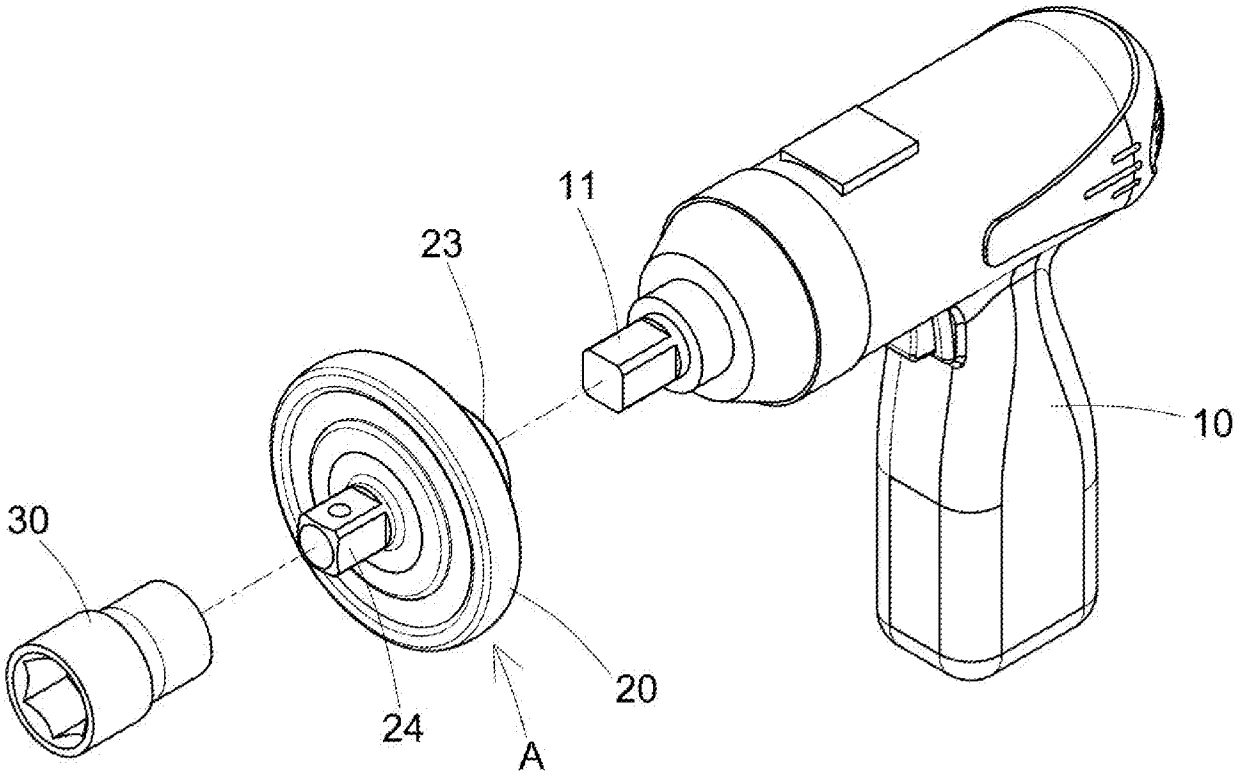
FIG. 1 is an exploded view according to a preferred embodiment of the present invention in cooperation with an electric tool.
Figure 2:
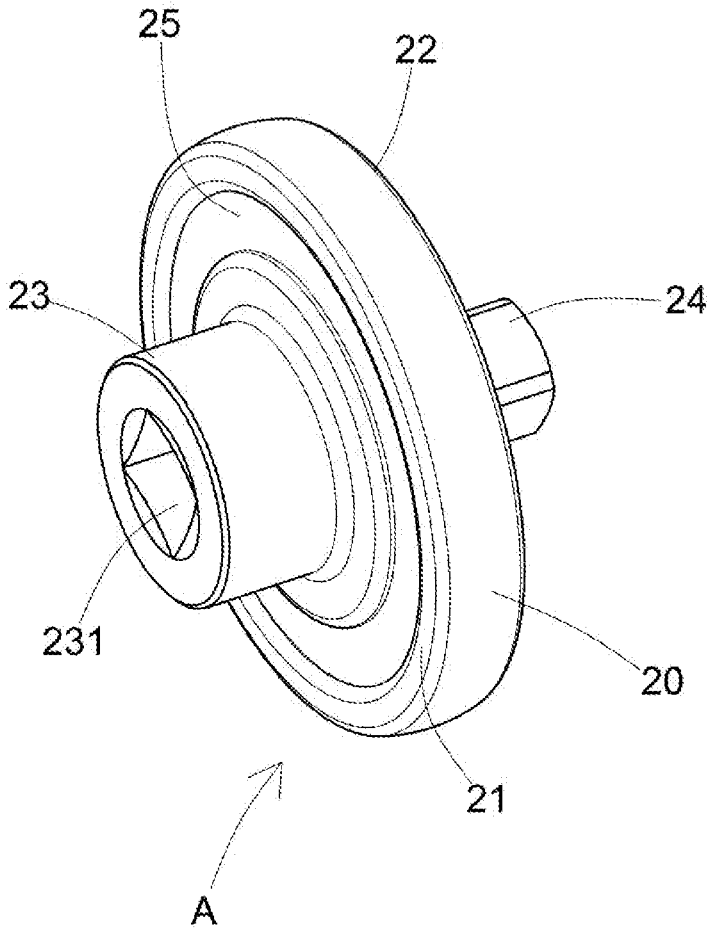
FIG. 2 is a perspective view of the present invention.
Figure 3:
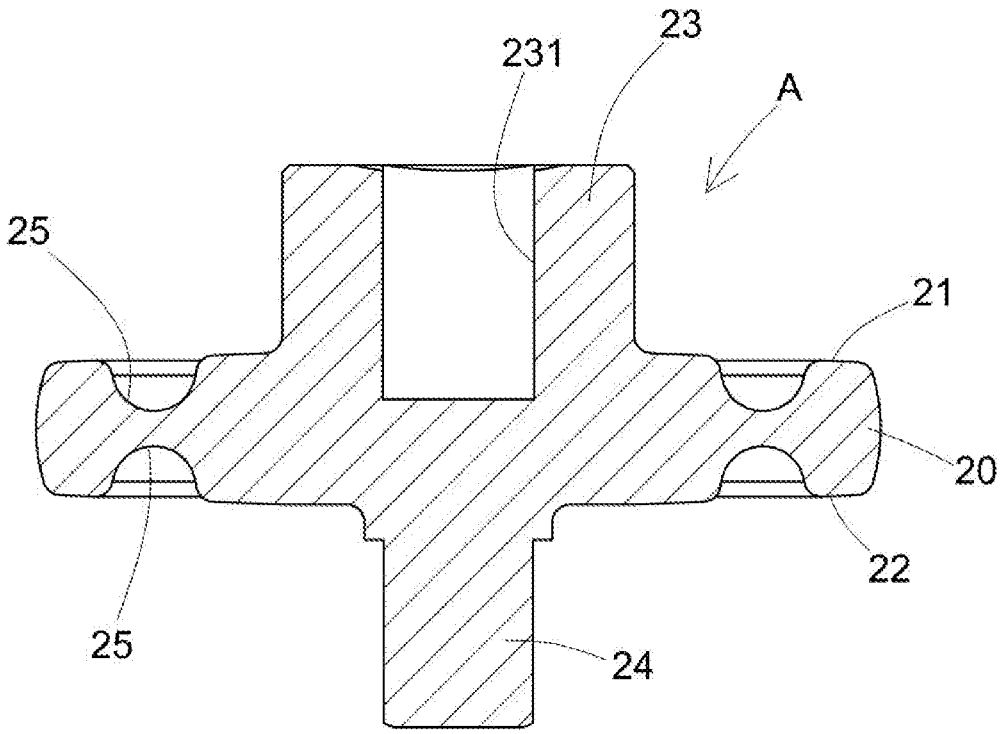
FIG. 3 is a sectional view of the present invention.
Figure 4:
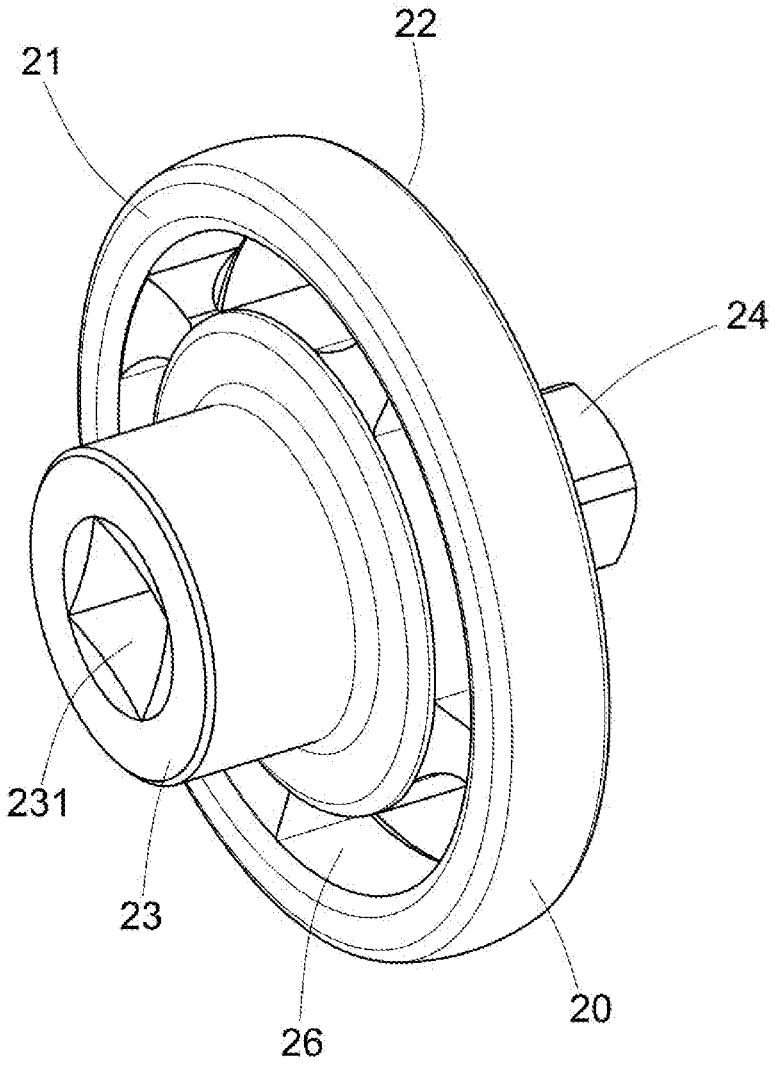
FIG. 4 is a perspective view according to another embodiment of the present invention.
Figure 5:
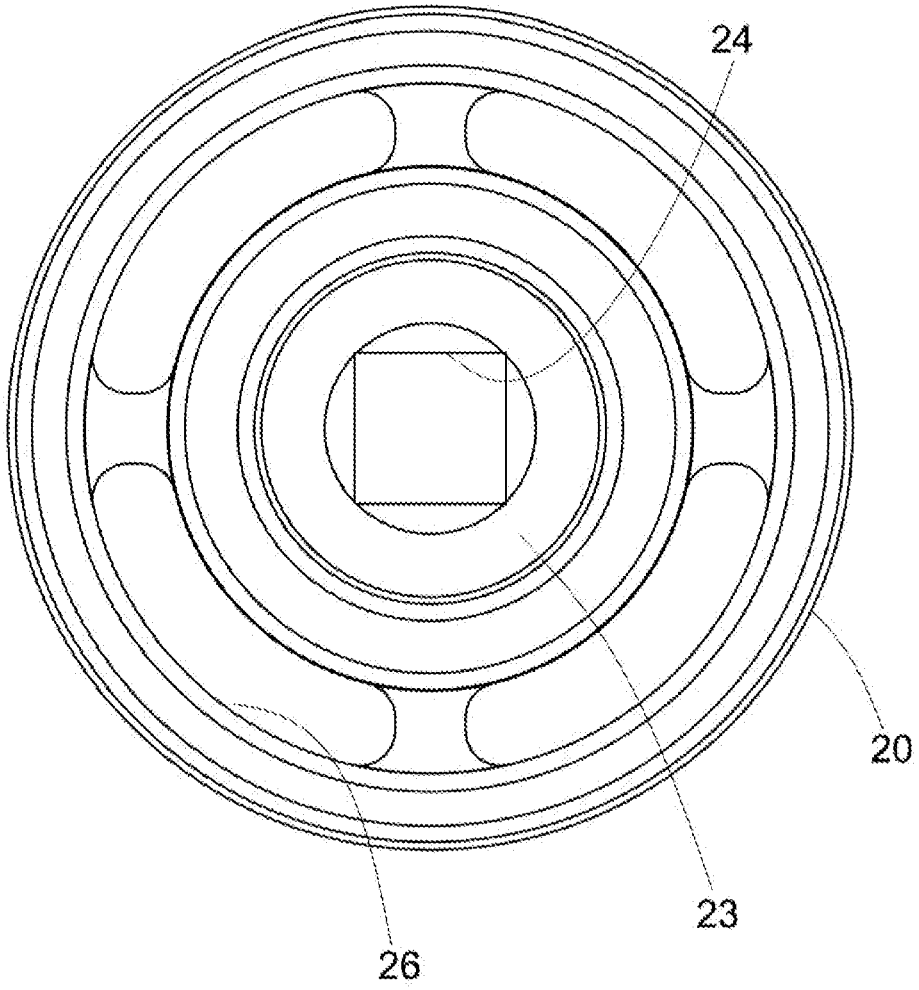
FIG. 5 is a side view according to another embodiment of the present invention.

First of all, referring to FIG. 1 to FIG. 5, the present invention discloses a rotary impact assembly structure. The rotary impact assembly structure comprises a rotary tool 10 and a rotary impact assembly A. The rotary tool 10 is assembled with the rotary impact assembly A so that the rotary impact assembly A is driven by the rotary tool 10 to rotate.

It should be noted that the rotary impact assembly A has a counterweight plate 20. The counterweight plate 20 has a first surface 21 and a second surface 22 at two sides thereof. The first surface 21 is provided with a socket portion 23 having an insertion hole 231 at a center thereof. The second surface 22 is provided with a plug portion 24 at a center thereof.

The first and second surfaces 21, 22 of the counterweight plate 20 each have an annular recess 25 at a predetermined position.

The counterweight plate 20 has a plurality of through holes 26.

The socket portion 23 of the counterweight plate 20 has a positioning assembly (not shown in the drawings) at a predetermined position.

The plug portion 24 of the counterweight plate 20 has a positioning assembly (not shown in the drawings) at a predetermined position.

The positioning assembly includes a spring and a steel ball (not shown).

The rotary tool 10 is a pneumatic tool or an electric tool.

As shown in FIG. 1 to FIG. 5, when the user wants to loosen or tighten a fastener (not shown in the drawings) by using the present invention, an operating portion 11 of the rotary tool 10 is mounted to the socket portion 23 or the plug portion 24 of the counterweight plate 20. If the operating portion 11 is a male plug, the operating portion 11 is inserted into the socket portion 23. If the operation portion 11 is a female socket, the operation portion 11 is fitted on the plug portion 24. In this embodiment, the operating portion 11 of the rotary tool 10 is a male plug.

After that, a connecting socket 30 (shown in FIG. 1) is fitted on the plug portion 24 of the counterweight plate 20, and the other end of the connecting socket 30 is fitted on the fastener (not shown in the drawings), such that the user can start the rotary tool 10 which may be a pneumatic tool or a power tool to rotate the operating portion 11 of the rotary tool 10 and synchronously rotate the counterweight plate 20. The connecting socket 30 utilizes the rotational inertia added by the counterweight plate 20 to increase the amount of torque applied to the fastener so as to quickly loosen or tighten the fastener. The overall operation is simple, convenient and practical.

It should be noted that in the present embodiment, the counterweight plate 20 has a diameter greater than that of the connecting socket 30, so the inertial gravitational acceleration is based on the counterweight plate 20. When the fastener is loosened or tightened, the torque or rotational speed of the rotary tool 10 will increase at a multiple of the diameter of the counterweight plate 20 and the connecting socket 30.

In addition, the counterweight plate 20 of the present invention can be matched with a plurality of connecting sockets 30 which may be in different sizes. It is convenient for use and can effectively reduce the purchase cost and is very practical.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A rotary impact assembly structure, comprising a rotary tool and a rotary impact assembly, the rotary tool is assembled with the rotary impact assembly so that the rotary impact assembly is driven by the rotary tool to rotate, characterized by: the rotary impact assembly having a counterweight plate, the counterweight plate having a first surface and a second surface at two sides thereof, the first surface being provided with a socket portion having an insertion hole at a center thereof, the second surface being provided with a plug portion at a center thereof, wherein the first and second surfaces of the counterweight plate each have an annular recess.

2. The rotary impact assembly structure as claimed in claim 1, wherein the counterweight plate has a plurality of through holes.

3. The rotary impact assembly structure as claimed in claim 1, wherein the socket portion of the counterweight plate has a positioning assembly.

4. The rotary impact assembly structure as claimed in claim 1, wherein the plug portion of the counterweight plate has a positioning assembly.

5. The rotary impact assembly structure as claimed in claim 3, wherein the positioning assembly includes a spring and a steel ball.

6. The rotary impact assembly structure as claimed in claim 4, wherein the positioning assembly includes a spring and a steel ball.

7. The rotary impact assembly structure as claimed in claim 1, wherein the rotary tool is a pneumatic tool or an electric tool.

* * * * *